US011890502B2

(12) United States Patent
Graham

(10) Patent No.: US 11,890,502 B2
(45) **Date of Patent: *Feb. 6, 2024**

(54) RANGE OF MOTION LIMITING DEVICE FOR SHUTTLE CARRIAGE

(71) Applicant: Gary Graham, Bellingham, WA (US)

(72) Inventor: Gary Graham, Bellingham, WA (US)

( * ) Notice: Subject to any disclaimer, the term of this patent is extended or adjusted under 35 U.S.C. 154(b) by 95 days.

This patent is subject to a terminal disclaimer.

(21) Appl. No.: 17/505,314

(22) Filed: Oct. 19, 2021

(65) Prior Publication Data

US 2022/0032116 A1 Feb. 3, 2022

Related U.S. Application Data

(63) Continuation of application No. 16/503,215, filed on Jul. 3, 2019, now Pat. No. 11,148,003.

(60) Provisional application No. 62/693,685, filed on Jul. 3, 2018.

(51) Int. Cl.
*A63B 21/00* (2006.01)
*A63B 21/002* (2006.01)

(52) U.S. Cl.
CPC ..... *A63B 21/4041* (2015.10); *A63B 21/0023* (2013.01); *A63B 21/159* (2013.01)

(58) Field of Classification Search
CPC ... A63B 22/0089; A63B 22/20; A63B 22/201; A63B 22/203; A63B 22/205; A63B 22/208; A63B 69/0057; A63B 21/0552; A63B 21/0428; A63B 21/159; A63B 21/0023; A63B 21/4041; A63B 2022/206
See application file for complete search history.

(56) References Cited

U.S. PATENT DOCUMENTS 1,782,728 A * 11/1930 Kiefer ..... A63B 22/0076 482/72
1,794,630 A * 3/1931 Linn ..... B62D 63/067 280/43
2,340,666 A 2/1944 Johanson
2,664,886 A 1/1954 Coffman
3,323,366 A 6/1967 Lorme et al.
3,574,900 A 4/1971 John
3,582,069 A * 6/1971 Flick ..... A63B 22/203 601/33
3,620,530 A 11/1971 Cosby
(Continued)

FOREIGN PATENT DOCUMENTS

GB 2419826 B 2/2007

*Primary Examiner* — Loan B Jimenez
*Assistant Examiner* — Thao N Do

(57) ABSTRACT

A range of motion limiting device, in one example comprising a first armature configured to engage a carriage moving on at least one rail having a first surface and a second surface transversely offset from the first surface of the rail. Also disclosed is an example utilizing a first bumper adjacent the first longitudinal end of the first armature. The first bumper extending transversely from the first transverse side of the first armature, optionally having a distal end with a non-slip surface engaging the first surface of a rail. Also disclosed is a second bumper longitudinally offset from the first bumper on the first armature, the second bumper extending transversely from the second transverse side of the first armature, also optionally having a distal end with a non-slip surface engaging the second surface of the rail.

13 Claims, 3 Drawing Sheets

(56) References Cited

U.S. PATENT DOCUMENTS 3,658,327 A * 4/1972 Thiede ..... A63B 21/0628 482/133
3,770,267 A 11/1973 McCarthy
4,004,801 A 1/1977 Campanaro et al.
4,402,506 A 9/1983 Jones
4,444,389 A * 4/1984 Wrucke ..... A63B 23/085 482/79
4,561,649 A 12/1985 Forsythe
4,627,610 A * 12/1986 Ishida ..... A63B 23/03575 482/73
4,653,749 A 3/1987 Rorabaugh
4,706,953 A 11/1987 Graham
4,869,499 A 9/1989 Schiraldo
4,880,199 A 11/1989 Harney
4,883,268 A 11/1989 Salkind
4,884,802 A 12/1989 Graham
4,915,031 A 4/1990 Wiebe
5,029,848 A 7/1991 Sleamaker
5,039,093 A 8/1991 Collier
5,042,797 A 8/1991 Graham
5,066,005 A 11/1991 Luecke
5,260,870 A 11/1993 Tsuchiya et al.
5,263,913 A 11/1993 Boren
5,279,530 A 1/1994 Hess
5,312,315 A * 5/1994 Mortensen ..... A63B 21/0087 482/148
5,318,495 A 6/1994 Malynowsky
5,328,427 A * 7/1994 Sleamaker ..... A63B 69/0022 482/110
5,364,327 A 11/1994 Graham
5,499,958 A 3/1996 Hess
5,518,483 A 5/1996 Oswald
D375,767 S 11/1996 Camfield et al.
5,599,260 A 2/1997 Rovinsky et al.
5,620,403 A 4/1997 Lundin
5,643,162 A * 7/1997 Landers ..... A63B 21/4035 482/131
5,645,516 A 7/1997 Foster
5,653,667 A 8/1997 Reyes
5,681,249 A 10/1997 Endelman
6,010,434 A 1/2000 Hodges
6,042,523 A 3/2000 Graham
6,099,445 A 8/2000 Rovinsky et al.
6,120,425 A 9/2000 Endelman
6,186,929 B1 2/2001 Endelman et al.
6,244,992 B1 6/2001 James
6,338,704 B1 1/2002 Endelman
6,371,895 B1 4/2002 Endelman et al.
6,383,122 B1 * 5/2002 Graham ..... A63B 22/0087 482/121
6,527,685 B2 3/2003 Endelman et al.
6,589,142 B2 7/2003 McAfee, Jr.
6,626,802 B1 * 9/2003 Rodgers, Jr. ..... A63B 22/0017 482/110
6,685,606 B2 2/2004 Endelman
6,827,675 B1 12/2004 Graham
6,926,650 B2 8/2005 Endelman et al.
6,971,976 B2 12/2005 Endelman et al.
7,104,937 B2 9/2006 Arbuckle et al.
7,125,368 B2 10/2006 Endelman
7,125,369 B2 10/2006 Endelman
7,163,500 B2 1/2007 Endelman et al.
7,288,053 B2 10/2007 Endelman et al.
7,288,054 B2 10/2007 Endelman et al.
7,465,261 B2 12/2008 Barnard et al.
7,606,953 B2 10/2009 Ash et al.
7,682,297 B2 3/2010 Graham
7,803,095 B1 * 9/2010 LaGree ..... A63B 22/0089 482/121
7,871,358 B2 1/2011 Graham
7,955,229 B2 6/2011 Graham
9,108,079 B2 * 8/2015 Solow ..... A63B 22/0089
9,919,181 B1 * 3/2018 Lee ..... A63B 21/4047
10,022,579 B1 7/2018 Graham
10,046,193 B1 * 8/2018 Aronson ..... A63B 21/0407
10,300,322 B2 5/2019 Graham
11,148,003 B1 * 10/2021 Graham ..... A63B 21/0552
2001/0053734 A1 12/2001 Lapcevic
2001/0056011 A1 12/2001 Endelman et al.
2002/0042329 A1 * 4/2002 Nizamuddin ..... A63B 22/203 482/51
2002/0058573 A1 5/2002 Endelman et al.
2002/0137604 A1 9/2002 Chen
2003/0119635 A1 6/2003 Arbuckle et al.
2003/0119636 A1 6/2003 Endelman
2003/0195095 A1 10/2003 Endelman et al.
2004/0002410 A1 1/2004 Steinbach et al.
2004/0058784 A1 3/2004 Roberts
2004/0176227 A1 9/2004 Endelman
2004/0235623 A1 11/2004 Martinez
2005/0085357 A1 4/2005 Endelman
2005/0113226 A1 5/2005 Endelman et al.
2005/0113227 A1 5/2005 Endelman et al.
2005/0250621 A1 11/2005 Corbalis et al.
2006/0035769 A1 2/2006 Phillips
2006/0046914 A1 3/2006 Endelman et al.
2006/0148625 A1 7/2006 Garner
2006/0189438 A1 8/2006 Black
2006/0199712 A1 9/2006 Barnard et al.
2006/0252616 A1 * 11/2006 Gerschefske ..... A63B 22/205 482/142
2007/0087921 A1 4/2007 Graham
2009/0118108 A1 5/2009 Uygan
2010/0216612 A1 * 8/2010 Graham ..... A63B 23/0417 482/121
2011/0028278 A1 2/2011 Roach
2014/0087922 A1 * 3/2014 Bayerlein ..... A63B 21/00181 482/54
2014/0121076 A1 * 5/2014 Lagree ..... A63B 22/0089 482/123
2015/0360113 A1 * 12/2015 Lagree ..... A63B 21/00061 482/121
2016/0059061 A1 * 3/2016 Lagree ..... A63B 21/4035 482/92
2016/0089558 A1 * 3/2016 Noyes ..... A63B 21/4029 482/130
2016/0166870 A1 * 6/2016 Lagree ..... A63B 24/0087 482/142
2017/0113091 A1 4/2017 Lagree
2018/0169464 A1 6/2018 Janowski
2019/0151741 A1 5/2019 Summit
2020/0001130 A1 1/2020 Schwarz

* cited by examiner

RANGE OF MOTION LIMITING DEVICE FOR SHUTTLE CARRIAGE

RELATED APPLICATIONS

This application is a Continuation of and claims priority benefit of U.S. patent application Ser. No. 16/503,215 filed on Jul. 3, 2019, which claims priority benefit of U.S. Provisional Patent Application Ser. No. 62/693,685 filed on Jul. 3, 2018, incorporated herein by reference.

BACKGROUND OF THE DISCLOSURE

Field of the Disclosure

Disclosed herein is a range of motion limiting device configured to be placed in a rail or rails of a frame to limit the longitudinal movement of a carriage traveling on the rail(s). In one example, the device is used to limit the range of motion of a physical therapy or exercise apparatus.

BRIEF SUMMARY OF THE DISCLOSURE

Disclosed herein are several examples of a range of motion limiting device. One example comprising: a first armature having a first longitudinal end, a second longitudinal end; a first transverse side, a second transverse side; the first longitudinal end of the first armature configured to engage a carriage moving on at least one rail having a first surface and a second surface transversely offset from the first surface of the at least one rail; a first bumper adjacent the first longitudinal end of the first armature, extending transversely from the first transverse side of the first armature; the first bumper having a distal end with a non-slip surface engaging the first surface of the at least one rail; a second bumper longitudinally offset from the first bumper on the first armature, the second bumper extending transversely from the second transverse side of the first armature; the second bumper having a distal end with a non-slip surface engaging the second surface of the at least one rail; and the range of motion limiting device configured such that force exerted by the carriage is transmitted to the first armature, wherein this force rotationally biases the first bumper against the first surface of the at least one rail and the second bumper against the second surface of the at least one rail in a camming action, prohibiting further longitudinal movement of the carriage toward the first armature.

The range of motion limiting device may further comprise a lateral cross member having a first end affixed to the first longitudinal armature and extending laterally therefrom.

The range of motion limiting device may further comprise a second longitudinal armature affixed to a second end of the lateral cross member, the second longitudinal armature comprising: a second armature having a first longitudinal end, a second longitudinal end; a first transverse side, a second transverse side; the first longitudinal end of the second armature configured to engage the carriage; a first bumper adjacent the first longitudinal end of the second armature, extending transversely from the first transverse side of the second armature; the first bumper having a distal end with a non-slip surface engaging the first surface of the at least one rail; a second bumper longitudinally offset from the first bumper on the second armature, the second bumper extending transversely from the second transverse side of the second armature; the second bumper having a distal end with a non-slip surface engaging the second surface of the at least one rail; and the range of motion limiting device configured such that force exerted by the carriage is transmitted to the second armature, wherein this force rotationally biases the first bumper against the first surface of the at least one rail and the second bumper against the second surface of the at least one rail in a camming action, prohibiting further longitudinal movement of the carriage toward the second armature.

The range of motion limiting device may be arranged wherein the cross member comprises: a first lateral end connected to the first armature; a second lateral end connected to the second armature; a median portion extending between the first lateral end and the second lateral end; and wherein the median portion is transversely offset from the first armature and the second armature.

The range of motion limiting may be arranged wherein the cross member comprises: a first extension having a first end at the first armature and a second end at the median portion; the first extension at an angle of between 20° and 65° to the median portion; a second extension having a first end at the second armature and a second end at the median portion; and the first extension at an angle of between 20° and 65° to the median portion.

The range of motion limiting device may be arranged wherein the lateral cross member is configured to directly contact the carriage.

The range of motion limiting device may be arranged wherein the lateral cross member directly contacts the carriage.

The range of motion limiting device may be arranged wherein the lateral cross member is comprised of spring steel.

The range of motion limiting device may further comprise a reinforcing member extending from the median portion and configured to add transverse rigidity to the median portion.

The range of motion limiting device may be arranged wherein the reinforcing member is a unitary structure with the median portion, extending therefrom at a fold.

The range of motion limiting device may further comprise: a stiffener affixed to the first armature, the stiffener configured to reduce longitudinal flexing of the first armature; and a stiffener affixed to the second armature, the stiffener configured to reduce longitudinal flexing of the second armature.

The range of motion limiting device may be arranged where the non-slip surface of the second bumper is elastic.

The range of motion limiting device may be arranged wherein the non-slip surface of the first bumper is elastic.

The range of motion limiting device may further comprise a stiffener affixed to the first armature, the stiffener configured to reduce longitudinal flexing of the first armature.

The range of motion limiting device may be arranged wherein the carriage is a component of a shuttle table.

In another example is disclosed a range of motion limiting device comprising: a first armature having a first longitudinal end, a second longitudinal end; a first transverse side, a second transverse side; the first longitudinal end of the first armature contacting a carriage moving on at least one rail having a first surface and a second surface transversely offset from the first surface of the at least one rail; a first bumper adjacent the first longitudinal end of the first armature, extending transversely from the first transverse side of the first armature; the first bumper having a distal end with a non-slip surface in contact with the first surface of the at least one rail; a second bumper longitudinally offset from the first bumper on the first armature, the second bumper extending transversely from the second transverse side of the first armature; and the second bumper having a distal end with a non-slip surface in contact with the second surface of the at least one rail.

DETAILED DESCRIPTION OF THE DISCLOSURE

Disclosed herein is a range of motion limiting device configured to be placed in a rail or rails of a frame to limit the longitudinal movement of a carriage traveling on the rail(s).

Figure 1:
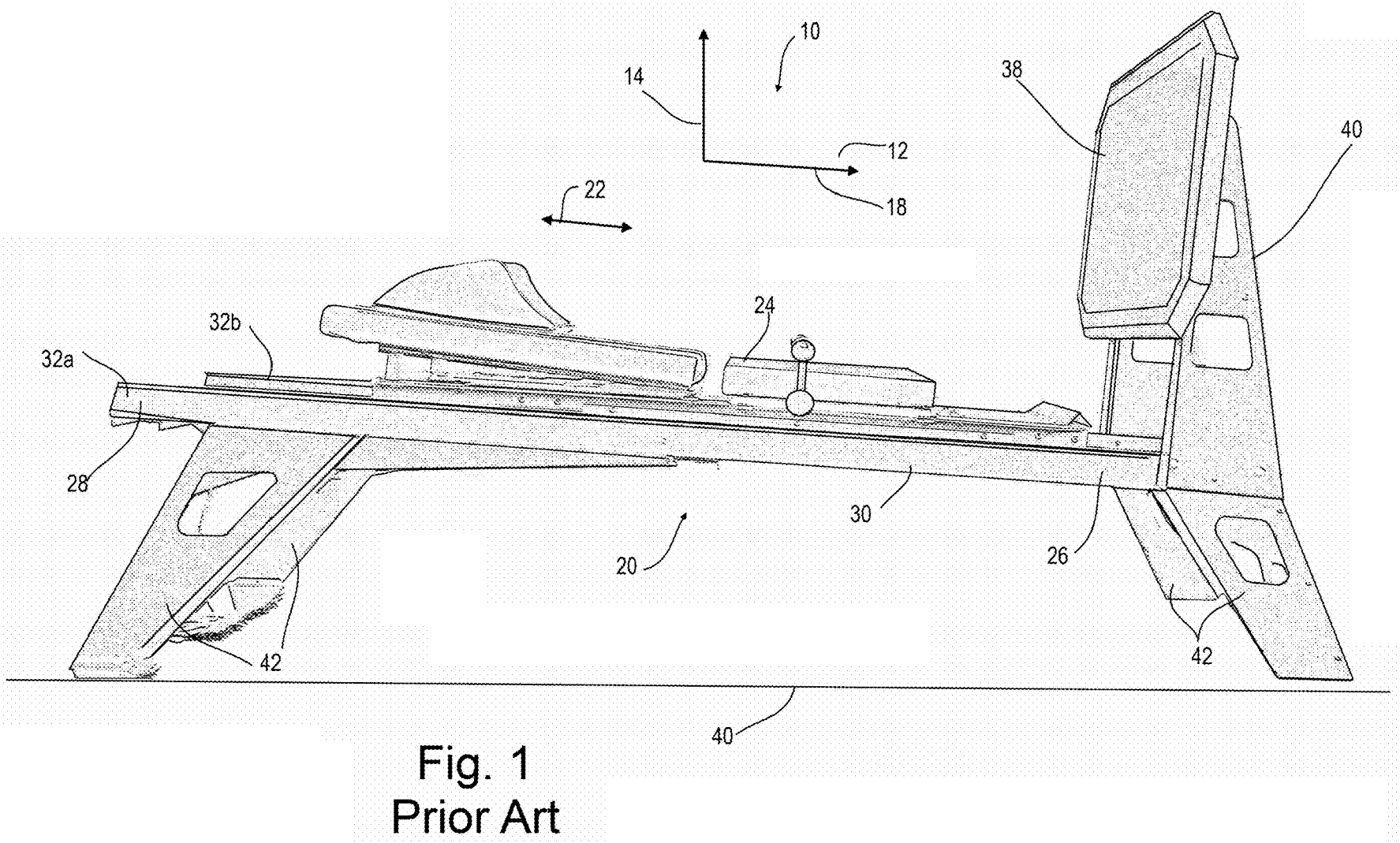
Fig. 1 Prior Art
FIG. 1 is a side perspective view of one example of a prior art exercise table to which the disclosed range of motion limiting device may be configured.
Figure 2:
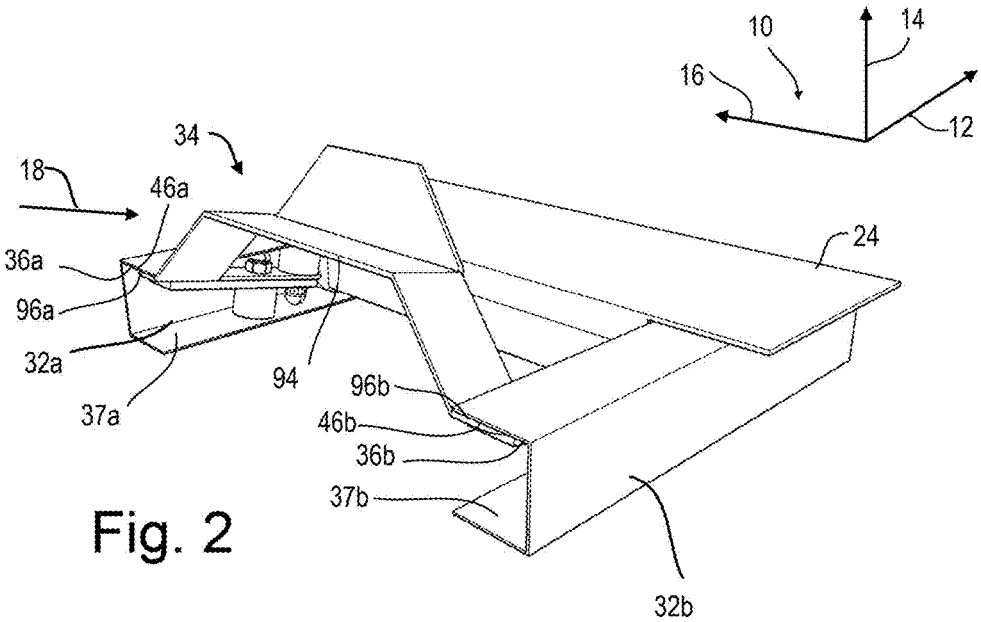
FIG. 2 is a highly schematic side perspective view of a plurality of rails forming part of a frame incorporating a range of motion limiting device as disclosed.
Figure 3:
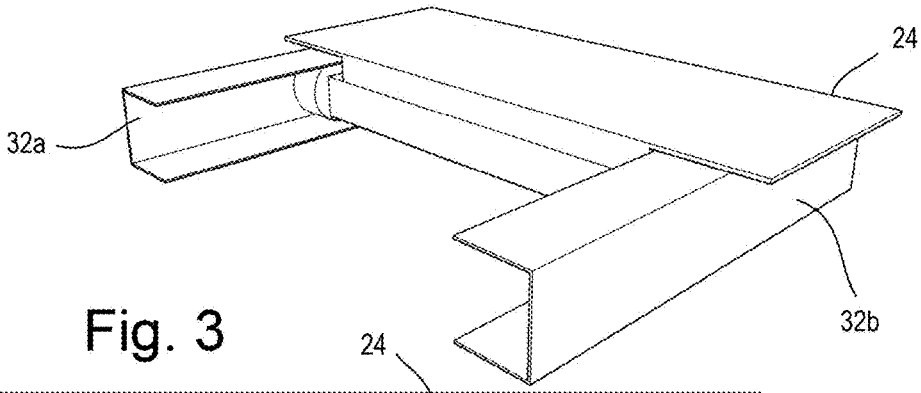
FIG. 3 is a highly schematic view of the rails and carriage to which may be attached the disclosed range of motion limiting device.

In some apparatuses, for example in the field of therapy, shuttle, or exercise tables 20 as shown in FIG. 1 as well as those disclosed in U.S. Pat. Nos. 6,383,122 B1, 7,682,297 B2, 7,871,358 B2, each incorporated herein by reference, it is often desired to limit the range of motion or travel 22 of a carriage 24 between a footward end 26 and a headward end 28 of a frame 30 upon which the carriage 24 travels. In some applications, cords, bands, and other length adjustable static and elastic members may be attached between the frame 30 and the carriage to control, bias, or limit the range of motion or travel 22 of the carriage 24 on the frame 30. Several of those references listed above refer to such systems. Disclosed herein is an apparatus which is positioned against (between) facing surfaces of a rail 32 or rails 32*a*/32*b* wherein contact of the carriage 24 against the rails 32 of such a range of motion limiting device 34 wedges or in other terms creates a camming action between facing surfaces 36*a* and 37*a* (see FIG. 2) of the rail 32. This camming action prohibiting further movement of the carriage 24 in a longitudinal direction as the carriage 24 presses against the range of motion limiting device 34.

To aid in description, an axes system 10 is disclosed herein comprising a longitudinal axis 12 parallel to the armature(s) of the range of motion limiting device 34. Also disclosed is a transverse axis 14 perpendicular to the armature(s). Also disclosed is a lateral axis 16 lying perpendicular to the plane of travel of the carriage 24 and the transverse axis 14. An oblique axis 18 is disclosed, parallel to the line of travel 22 of the carriage 24. As will be disclosed herein, in use the longitudinal axis 12 is not necessarily parallel to the oblique axis 18.

In use, a user will be supported by the carriage 24, by lying, sitting, kneeling thereupon and then press against the kick plate 38 to move themselves and the carriage 24 towards the headward end of the frame 30. Commonly the user's feet will engage the kick plate 38 and the user will be biased away from the kick plate 38 as they press against the kick plate 38 with sufficient force to overcome friction, gravity resistance, and the force of any resilient members (e.g., elastic cords). To add rigidity, the kick plate 38 is commonly fixed to the frame 30 by way of a kick plate support 40 fixed to the kick plate 38 and attached to the frame 30. To aid in use and comfort, the frame 30 may be raised above the floor 40 by way of one or more legs 42. A therapist or other practitioner may devise an exercise regimen for a user, the user then employing the shuttle table 20 to facilitate the exercise regimen. In some exercises, it may be desired to limit the movement of the carriage 24 on the frame 30 either towards the headward end 28 and/or the footward end 26.

Disclosed herein are several examples of a range of motion limiting device 34 which is specifically configured to be fitted to the frame 30 at either the footward end 26 or the headward end 28.

Figure 5:
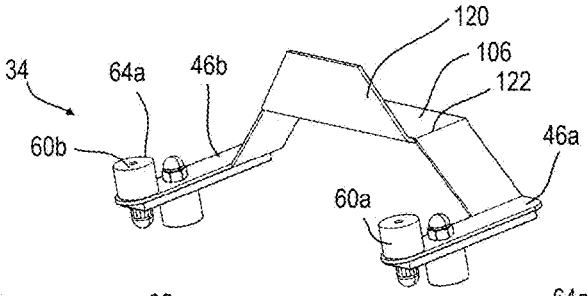
FIG. 5 is a front perspective view of the range of motion limiting device shown in FIG. 1.
Figure 6:
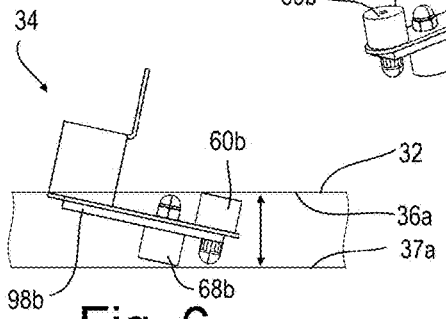
FIG. 6 is a right-side view of the range of motion limiting device shown in FIG. 1.
Figure 7:
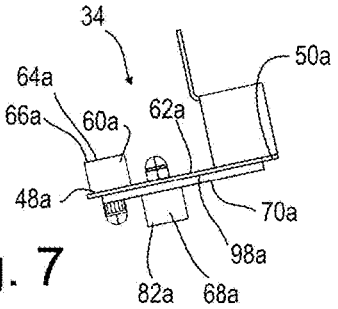
FIG. 7 is a left side view of the range of motion limiting device shown in FIG. 1.
Figure 8:
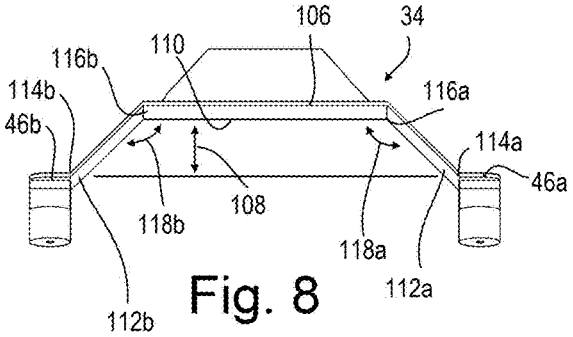
FIG. 8 is a front view of the range of motion limiting device shown in FIG. 1.
Figure 9:
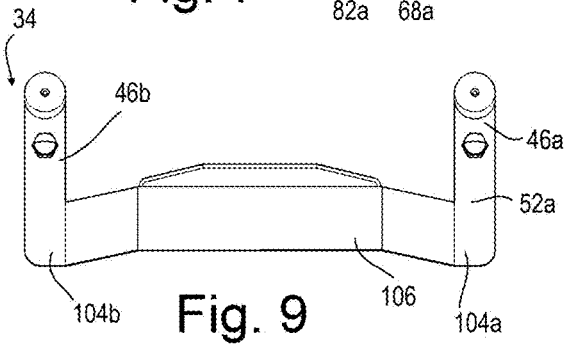
FIG. 9 is a top view of the range of motion limiting device shown in FIG. 1.
Figure 10:
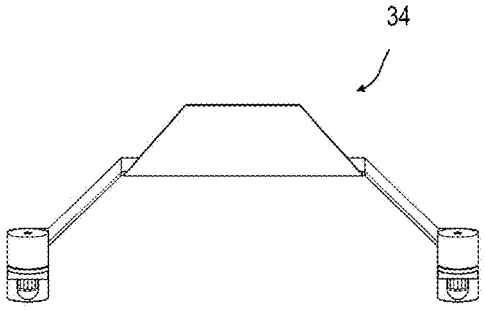
FIG. 10 is a rear view of the range of motion limiting device shown in FIG. 1.

In one example, the range of motion limiting device 34 as seen in FIG. 5 comprises a first armature 46*a* having a first longitudinal end 48*a*, a second longitudinal end 50*a*; a first transverse side 52*a*, and a second transverse side 56*a*. To aid in description, general terms will utilize a numeric label, and specific elements will use an alphabetic identifier. For example, the rails are labeled as 32, while specific rails (e.g., right and left rails) are identified as 32*a* and 32*b*.

In one example, the first armature 46*a* is configured to be pressed against by the carriage 24 moving on at least one rail 32 having a first surface 36*a*, and a transversely facing second surface 37*a*. The second surface 37*a* transversely offset 58 from the first surface 36*a* of the rail 32. As the armature 46 is thus longitudinally pressed against by the carriage 24, the armature 46 is rotationally forced to a camming or wedging action against the surfaces 36*a*-37*a* of the rail 32. Additional force exerted by the carriage 24 will increase the camming action, tending to further resist forces exerted by the carriage 24 on the first armature 46 by camming or wedging between the surfaces 36*a*-37*a* of the rail 32.

Also disclosed is an example utilizing a first bumper 60 attached to the first armature 46*a* adjacent the first longitudinal end 48*a* of the first armature 46*a*. The first bumper 60 extends from the first transverse side 62*a* of the first armature 46*a*. The first bumper 60*a* optionally has a distal end 64*a* configured to press against the surface 36*a* of the rail and when so pressed prohibit sliding of the range of motion limiting system 34 relative to the rail 32. The distal end 64*a* in one example having a malleable and/or non-slip surface 66*a* thereon such as rubber, silicone, plastic, etc. The non-slip surface 66*a* directly engages the first surface 36 of a rail 32.

Also disclosed is a second bumper 68*a* longitudinally offset from the first bumper 60*a* on the first armature 46*a*. In one example, the second bumper 68*a* is shown extending transversely 14 from the second transverse side 70*a* of the first armature 46*a* in an opposing direction from the first bumper 60*a*. The second bumper 68*a* also optionally having a distal end 72*a* with a malleable and/or non-slip surface 74*a* engaging the second surface 37 of the rail 32.

Figure 4:
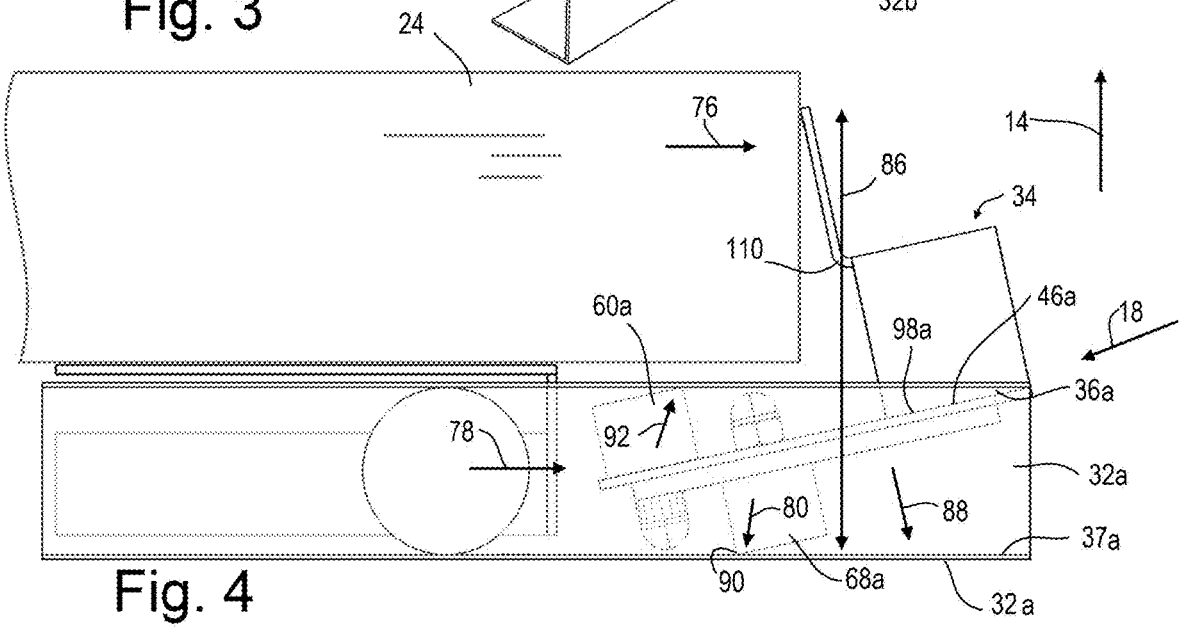
FIG. 4 is a side hidden line view of the example shown in FIG. 1.

In operation, the range of motion limiting device 34 is configured such that force 76 exerted longitudinally by the carriage 24 against the first armature 46*a* rotationally biases the first bumper 60*a* against the first surface 36*a* of the rail 32*a* and the second bumper 68*a* against the second surface 37*a* of the rail 32*a* in a camming action. This camming action prohibiting further longitudinal movement 78 of the carriage 24 in a direction toward the first armature 46*a*. In other terms, as most easily understood by looking to the example of FIG. 4, force 76 of the carriage 24 pressing against the range of motion limiting device 34 is translated to a force 80 pressing the second bumper 68*a* against the surface 37*a* of the rail 32*a*. As the bumper 68 may comprise elastic such as rubber, silicone, wood, or other polymeric or natural materials, it may deform slightly as it is compressed. Where the second bumper 68*a* includes a non-slip surface 82*a* on the distal end thereof, a transverse offset 86 from the point of contact between the carriage and the range of motion limiting device 34 forms a lever arm such that the force 76, exerted on the range of motion limiting device 34 from longitudinal movement 78 of the carriage 34 presses the bumper 68*a* against the surface 37, which results in a rotational bias 88 about a pivot 90 or point of contact. This rotational bias 88 presses the first bumper 60*a* against the surface 36*a* as a force 92. Where the distal end 64*a* of the first bumper 60*a* also comprises a non-slip surface, longitudinal movement is additionally resisted. Addition of force 76 presses the bumpers 68*a*, 60*a* with increasing force in a wedging or camming action.

The range of motion limiting device in one example further comprises a lateral cross member 94 having a first end 96*a* affixed to the first armature 46*a* and extending laterally therefrom. The range of motion limiting device 34 may further comprise a second armature 46*b* affixed to a second end 96*b* of the lateral cross member 94. In one example the second armature 46*b* is substantially a mirror image of the first armature 46*a*. The same components may be utilized on the second armature 46*b* as the first armature 46*a*, such as a first bumper 60*b*, second bumper 68*b*, etc. Many components of the second armature equivalent to a component of the first armature are shown here having an alphabetic identifier "b" where the equivalent component of the first armature has an alphabetic identifier "a".

Figure 11:
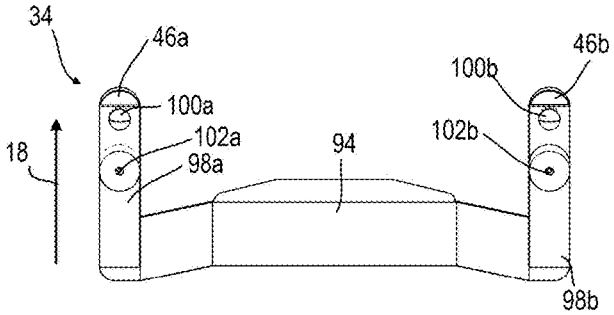
FIG. 11 is a bottom view of the range of motion limiting device shown in FIG. 1.

The range of motion limiting device 34 as recited herein may further comprise a stiffener 98 (98*a*, 98*b*) affixed to the first armature 46*a* and/or the second armature 46*b*, each stiffener 98 is configured to reduce longitudinal flexing of the first armature from the first end 48 to the second end 50 in a transverse direction and torsional about the axis of the armature 46. In one example, such as shown in FIG. 11, the first armature 46*a*, second armature 46*b*, and lateral cross member 94 may be comprised of a unitary structure, folded or bent to the desired final shape. The material comprising this unitary structure may be structurally insufficient to provide the desired strength and resiliency to the armature 46, the stiffener 98 may be attached thereto. In one example, the first bumpers 60 and second bumpers 68 may be attached to the armature 46 via fasteners 100 and 102 respectively. These fasteners may also function to fasten the stiffener 98 to the associated armature 46.

The range of motion limiting device 34 may be arranged wherein the lateral cross member 94 comprises: a first lateral end 104*a* connected to the first armature 46*a*; a second lateral end 104*b* connected to the second armature 46*b*; a median portion 106 extending between the first lateral end 104*a* and the second lateral end 104*b*. In one example the median portion 106 is transversely offset 108 from the first armature 46*a* and the second armature 46*b*. This transverse offset 108 making adjustment, insertion, and manipulation simple, easy, and requiring very little force; as a user may grasp a grasping portion 110 generally clear (substantial clearance there between) of the frame 30 of the shuttle table 20. By so grasping the range of motion limiting device 34, a user will be able to insert one or more of the armatures 46 into one or more corresponding rails 32 and slide the range of motion limiting device into the headward end 28 or footward end 26 of the frame 30 to a position where it is desired that the carriage 24 not pass.

In one example, the transverse offset 108 between the median portion 106 to the first armature 46*a* and the second armature 46*b* also increasing the transverse distance 86 between the pivot point 90 and the contact point 112 between the carriage 24 and the range of motion limiting device 34. As previously described, this distance 86 forming a lever arm increasing the camming force in direction 88/92 and countering any longitudinal force 78.

The range of motion limiting device 34 may be arranged wherein the cross member 94 comprises: a first extension 112*a* having a first end 114*a* at the first armature 46*a* with a second end 116*a* at the median portion 106. In one example, the first extension 112*a* is at an angle 118*a* of between 20° and 65° to the median portion 106. In one example, the first extension 112*a* is a unitary continuous construction with the first armature 46*a* and/or the median portion 106 extending therefrom at a bend or fold. Similarly, in one example is disclosed a second extension 112*b* having a first end 114*b* at the second armature with a second end 116*b* at the median portion 106. In one example the first extension at an angle 118*b* of between 20° and 65° to the median portion. In one example, the second extension 112*b* is a unitary continuous construction with the second armature 46*b* and/or the median portion 106 extending therefrom at a bend or fold.

The range of motion limiting device 34 may further comprise a reinforcing member 120 extending from the median portion 106 and configured to add transverse rigidity to the median portion 106. The reinforcing member 120 may comprise a unitary structure with the median portion 106. The reinforcing member 120 extending from the median portion 106 at a bend or fold 122. Where the median portion 106 and other components may be made of plate steel or equivalent components, cut, formed, bent, folded, welded, fastened, or adhered together to form the range of motion limiting device 34, the reinforcing member 120 is configured to resist lateral bending, and torsional bending of the median portion.

The range of motion limiting device 34 may be arranged where the non-slip surface 82 of each second bumper 68, or non-slip surface 66 of the first bumper 60 is malleable and/or elastic. Elastic meaning the material returns to its original length, shape, etc., after being deformed or compressed.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept. The invention illustratively disclosed herein suitably may be practiced in the absence of any element which is not specifically disclosed herein.

The invention claimed is:

1. A range of motion limiting device comprising:

a first armature having a first longitudinal end, a second longitudinal end; a first transverse side, a second transverse side;

the first longitudinal end of the first armature configured to engage a carriage moving on at least one rail having a first surface and a second surface transversely offset from the first surface of the at least one rail;

a first bumper adjacent the first longitudinal end of the first armature, extending transversely from the first transverse side of the first armature;

the first bumper having a distal end engaging the first surface of the at least one rail;

a second bumper longitudinally offset from the first bumper on the first armature, the second bumper extending transversely from the second transverse side of the first armature;

the second bumper having a distal end engaging the second surface of the at least one rail; and the range of motion limiting device configured a contact force from the carriage rotationally biases the first bumper against the first surface of the at least one rail and the second bumper against the second surface of the at least one rail in a camming action, thus prohibiting further longitudinal movement of the carriage toward the first armature.

2. The range of motion limiting device as recited in claim 1 further comprising a lateral cross member having a first end affixed to the first longitudinal armature and extending laterally therefrom.

3. The range of motion limiting device as recited in claim 2 further comprising a second longitudinal armature affixed to a second end of the lateral cross member, the second longitudinal armature comprising:

a second armature having a first longitudinal end, a second longitudinal end; a first transverse side, a second transverse side;

the first longitudinal end of the second armature configured to engage the carriage;

a first bumper of the second armature adjacent the first longitudinal end of the second armature, extending transversely from the first transverse side of the second armature;

the first bumper of the second armature having a distal end with a non-slip surface engaging the first surface of a second rail;

a second bumper of the second armature longitudinally offset from the first bumper of the second armature, the second bumper of the second armature extending transversely from the second transverse side of the second armature;

the second bumper of the second armature having a distal end with a non-slip surface engaging the second surface of the second rail; and the range of motion limiting device configured such that force exerted by the carriage is transmitted to the second armature, wherein the force rotationally biases the first bumper against the first surface of the second rail and the second bumper against the second surface of the second rail in a camming action, prohibiting further longitudinal movement of the carriage toward the second armature.

4. The range of motion limiting device as recited in claim 3 wherein the cross member comprises:

a first lateral end connected to the first armature;

a second lateral end connected to the second armature;

a median portion extending between the first lateral end and the second lateral end; and wherein the median portion is transversely offset from the first armature and the second armature.

5. The range of motion limiting device as recited in claim 4 wherein the cross member comprises:

a first extension having a first end at the first armature and a second end at the median portion;

the first extension at an angle of between 20° and 65° to the median portion;

a second extension having a first end at the second armature and a second end at the median portion; and the second extension at an angle of between 20° and 65° to the median portion.

6. The range of motion limiting device as recited in claim 2 wherein the lateral cross member is configured to directly contact the carriage.

7. The range of motion limiting device as recited in claim 2 wherein the lateral cross member directly contacts the carriage.

8. The range of motion limiting device as recited in claim 2 wherein the lateral cross member is comprised of spring steel.

9. The range of motion limiting device as recited in claim 1 further comprising:

a first stiffener affixed to the first armature, the first stiffener configured to reduce longitudinal flexing of the first armature; and a second stiffener affixed to the second armature, the second stiffener configured to reduce longitudinal flexing of the second armature.

10. The range of motion limiting device as recited in claim 1 where a non-slip surface of the second bumper is elastic.

11. The range of motion limiting device as recited in claim 1 wherein a non-slip surface of the first bumper is elastic.

12. The range of motion limiting device as recited in claim 1 further comprising a stiffener affixed to the first armature, the stiffener configured to reduce longitudinal flexing of the first armature.

13. The range of motion limiting device as recited in claim 1 wherein the carriage is a component of a shuttle table.

* * * * *